US011226119B2

(12) United States Patent
Asai

(10) Patent No.: US 11,226,119 B2
(45) Date of Patent: Jan. 18, 2022

(54) HEAT EXCHANGER UNIT AND AIR-CONDITIONING APPARATUS

(71) Applicant: Mitsubishi Electric Corporation, Tokyo (JP)

(72) Inventor: Toshiki Asai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 2 days.

(21) Appl. No.: 16/632,056

(22) PCT Filed: Sep. 21, 2017

(86) PCT No.: PCT/JP2017/034011
§ 371 (c)(1),
(2) Date: Jan. 17, 2020

(87) PCT Pub. No.: WO2019/058472
PCT Pub. Date: Mar. 28, 2019

(65) Prior Publication Data

US 2020/0240652 A1 Jul. 30, 2020

(51) Int. Cl.
*F24F 1/24* (2011.01)
*F24F 1/14* (2011.01)

(52) U.S. Cl.
CPC . *F24F 1/24* (2013.01); *F24F 1/14* (2013.01)

(58) Field of Classification Search
CPC ..... F24F 1/24; F24F 1/14
See application file for complete search history.

(56) References Cited

U.S. PATENT DOCUMENTS

2011/0114779 A1 5/2011 Tsubaki
2018/0274799 A1 9/2018 Morishita et al.

FOREIGN PATENT DOCUMENTS

| | | | | |
|---|---|---|---|---|
| EP | 1684022 A1 * | 7/2006 | ..... | F24F 1/50 |
| EP | 1684022 A1 | 7/2006 | | |
| EP | 2921795 A1 | 9/2015 | | |
| JP | H06-331176 A | 11/1994 | | |
| JP | 2003-214659 A | 7/2003 | | |
| JP | 2009-299987 A | 12/2009 | | |
| JP | 2010-016939 A | 1/2010 | | |
| JP | 2013-135196 A | 7/2013 | | |
| JP | 2013135196 A * | 7/2013 | | |
| JP | 2013-232505 A | 11/2013 | | |
| WO | 2017/078144 A1 | 5/2017 | | |

OTHER PUBLICATIONS

Chinese Office Action dated Dec. 30, 2020, issued in corresponding CN Patent Application No. 201780094875.4 (and English Machine Translation).

(Continued)

*Primary Examiner* — Schyler S Sanks
(74) *Attorney, Agent, or Firm* — Posz Law Group, PLC

(57) ABSTRACT

A heat exchanger unit connected to a refrigerant pipe in which refrigerant is sealed includes plural heat sources, each of the heat sources having a different amount of heat generation, and plural cooling units. Each of the cooling units cools an associated one of the heat sources. Cooling provided by each of the cooling units is different depending on amounts of heat generation of the associated heat source.

8 Claims, 5 Drawing Sheets

(56) References Cited

OTHER PUBLICATIONS

International Search Report of the International Searching Authority dated Dec. 19, 2017 in corresponding International Patent Application No. PCT/JP2017/034011 (and English translation).
Extended European Search Report dated Aug. 5, 2020 issued in the corresponding European patent application No. 17925880.1.
Office Action dated Jun. 1, 2021 issued in the corresponding CN patent application No. 201780094875.4 ( and English translation).

* cited by examiner

HEAT EXCHANGER UNIT AND AIR-CONDITIONING APPARATUS

CROSS REFERENCE TO RELATED APPLICATION

This application is a U.S. national stage application of PCT/JP2017/034011 filed on Sep. 21, 2017, the contents of which are incorporated herein by reference.

TECHNICAL FIELD

The present invention relates to cooling of electronic components provided in a heat exchanger unit.

BACKGROUND ART

In a conventional air-conditioning apparatus, a compressor, an outdoor unit, an indoor unit, a pressure reducing device and the like are connected by a pipe, and refrigerant that is sealed inside the pipe is circulated for conditioning air inside a room where the indoor unit is disposed. The outdoor unit and the indoor unit of the air-conditioning apparatus function as a heat exchanger unit in which refrigerant inside the pipe is circulated. The outdoor unit of such an air-conditioning apparatus includes a fan, a heat exchanger, a compressor, an electrical component box and the like. A circuit board on which electronic components for control are mounted, a circuit board on which a power module forming an inverter circuit is mounted, a reactor and the like are installed in the electrical component box. The power module generates a large amount of heat, and possibly acts as a heat source that affects operation of other electrical components mounted in the electrical component box. Accordingly, cooling of the power module is necessary.

Conventionally, refrigerant cooling has been known as a way of cooling a power module. In the refrigerant-cooling, a power module is cooled by exchanging heat between the power module and refrigerant inside a pipe. With refrigerant-cooling, a power module as a heat source may be cooled by controlling a flow rate of refrigerant in a pipe. However, if the power module is excessively cooled, dew condensation may occur around the power module. In Patent Literature 1, an expansion valve is controlled by using a dew condensation sensor configured to detect occurrence/non-occurrence of dew condensation, and a temperature of refrigerant is prevented from becoming too low and dew condensation at and around a power device is prevented.

CITATION LIST

Patent Literature

Patent Literature 1: Japanese Patent Laid-Open No. 2009-299987

SUMMARY OF INVENTION

Technical Problem

A refrigeration apparatus according to Patent Literature 1 has only one power device to be cooled, or in other words, heat source. However, a power module for driving a fan and a power module for driving a compressor are installed in an electrical component box of an outdoor unit. The amount of heat generation is different between the power modules. In a case where there is a plurality of heat sources with different amounts of heat generation, dew condensation may occur around a heat source that generates a smaller amount of heat if the flow rate of refrigerant is controlled by refrigerant-cooling to suit a heat source that generates a larger amount of heat. That is, when the flow rate of refrigerant is controlled on the basis of a temperature of a power module for driving a compressor, which generally generates a larger amount of heat, temperatures at and around a power module for driving a fan, which generates a smaller amount of heat, may become too low, resulting in dew condensation. When dew condensation occurs at such positions, an electrode of the power module or a wiring portion of a board where the power module is attached is possibly corroded, and also, insulation properties of the power module itself are possibly reduced.

An object of the present invention, which has been made to solve problems as described above, is to provide a highly reliable heat exchanger unit and a highly reliable air-conditioning apparatus that are capable of sufficiently cooling a plurality of heat sources with different amounts of heat generation while preventing dew condensation.

Solution to Problem

A heat exchanger unit according to one embodiment of the present invention is a heat exchanger unit connected to a refrigerant pipe in which refrigerant is sealed, the heat exchanger unit including: a plurality of heat sources, each of the heat sources having a different amount of heat generation; and a plurality of cooling units each configured to cool associated one of the plurality of heat sources, where cooling schemes of the plurality of cooling units are different depending on amounts of heat generation of the plurality of heat sources. Furthermore, an air-conditioning apparatus according to another embodiment of the present invention includes the heat exchanger unit described above.

Advantageous Effects of Invention

With the heat exchanger unit and the air-conditioning apparatus according to the embodiments of the present invention, each of the plurality of heat sources with different amounts of heat generation is cooled by a cooling scheme according to the amount of heat generation. Accordingly, the plurality of heat sources may each be sufficiently cooled, and also, a heat source with a small amount of heat generation is not excessively cooled and occurrence of dew condensation around such a heat source may be prevented. As a result, reliability of the heat exchanger unit may be increased.

DESCRIPTION OF EMBODIMENTS

Figure 1:
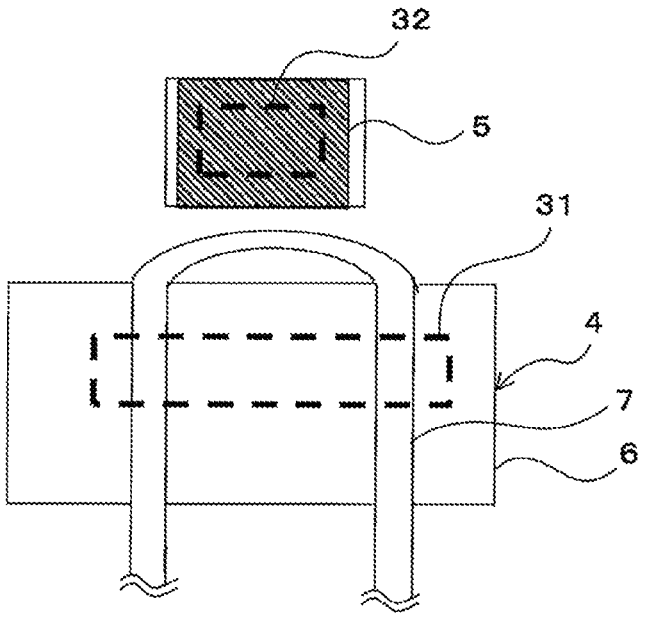
FIG. 1 is a schematic diagram for describing a cooling structure of an electrical component box of a heat exchanger unit according to Embodiment 1 of the present invention.

Hereinafter, embodiments of a heat exchanger unit of the present invention will be described in detail with reference to the drawings. Additionally, the present invention is not limited by the embodiments described below. Furthermore, in the drawings described below, the size of each structural part may be different from that of an actual device.

Embodiment 1

FIG. 1 is a schematic diagram for describing a cooling structure of an electrical component box of a heat exchanger unit according to Embodiment 1 of the present invention. A heat source 31 and a heat source 32 are illustrated in FIG. 1. The amount of heat generation of the heat source 31 is larger than the amount of heat generation of the heat source 32. A cooling part 4 is attached to the heat source 31 that generates a large amount of heat. A heat radiating part 5 is attached to the heat source 32 that generates a small amount of heat. The cooling part 4 is a first cooling unit of the present invention, and the heat radiating part 5 is a second cooling unit of the present invention.

The cooling part 4 is a refrigerant-cooling part configured to cool the heat source 31 using refrigerant. The cooling part 4 includes a plate 6 of metal having high thermal conductivity, such as aluminum. A copper refrigerant pipe 7 is embedded in the plate 6. The refrigerant pipe 7 forms a part of a refrigerant pipe that is connected to the heat exchanger unit and where refrigerant is sealed. One end portion of the refrigerant pipe 7 is connected to an expansion valve provided on the refrigerant pipe. The expansion valve adjusts the flow rate of refrigerant in the refrigerant pipe. At the plate 6, heat is exchanged between refrigerant flowing in the refrigerant pipe 7 and the heat source 31, and heat is absorbed from the heat source 31. The heat radiating part 5 is a cooling part configured to cool the heat source 32, as a cooling target, by air, and is for increasing a heat radiation area of the heat source 32. In Embodiment 1, a heat radiating fin is used as the heat radiating part 5. The heat radiating part 5 is installed with blades of the fin extending in parallel with a vertical direction.

According to a conventional technique, a plurality of heat sources are all cooled by refrigerant-cooling using a cooling part. Accordingly, in the case where the amount of heat generation is different between the plurality of heat sources, when the flow rate of refrigerant is controlled in a manner suited to a heat source that generates a large amount of heat to avoid insufficient cooling of the heat source that generates a large amount of heat, dew condensation possibly occurs around a heat source that generates a small amount of heat. In contrast, according to the structure of Embodiment 1, the heat source 31 that generates a large amount of heat is refrigerant-cooled by the cooling part 4, and the heat source 32 that generates a small amount of heat is air-cooled by the heat radiating part 5. Therefore, occurrence of dew condensation at the heat source 32 may be prevented.

Figure 2:
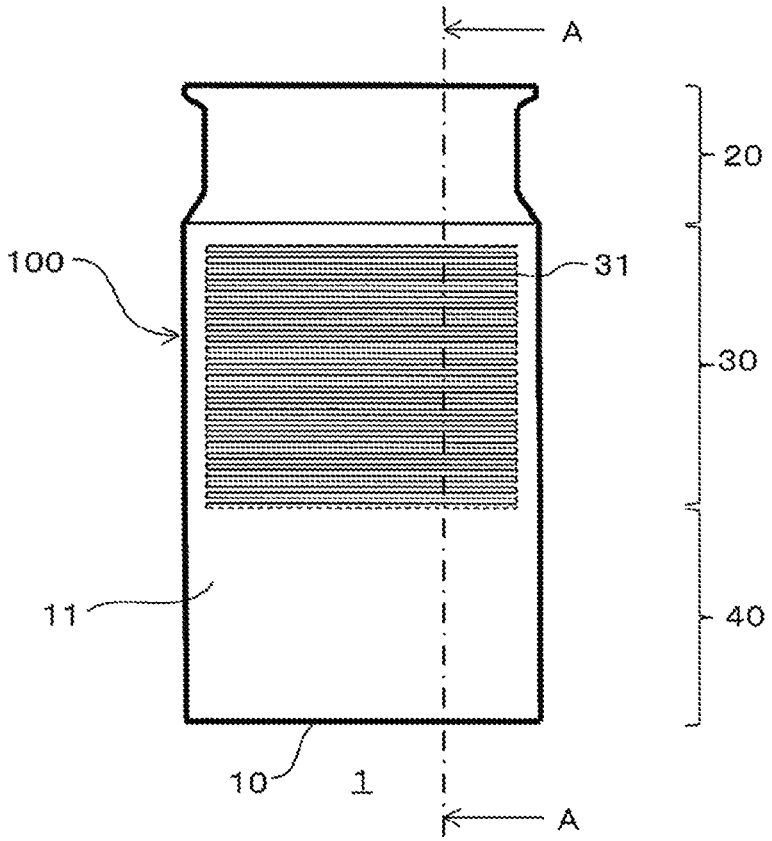
FIG. 2 is a front view of the heat exchanger unit according to Embodiment 1 of the present invention.
Figure 3:
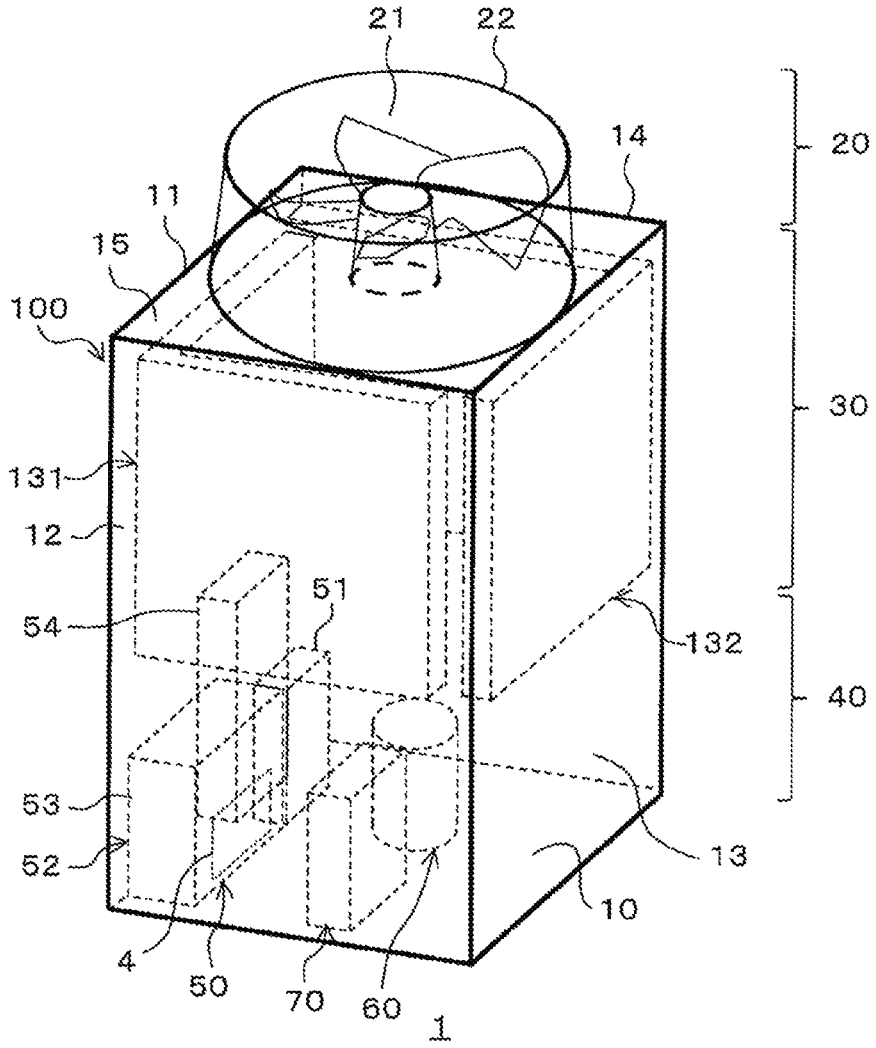
FIG. 3 is a perspective view schematically illustrating the heat exchanger unit according to Embodiment 1 of the present invention.

FIG. 2 is a front view of the heat exchanger unit according to Embodiment 1 of the present invention. FIG. 3 is a perspective view schematically illustrating the heat exchanger unit according to Embodiment 1 of the present invention. In FIGS. 2 and 3, an outdoor unit 1 is illustrated as the heat exchanger unit. In FIG. 3, some elements provided inside are indicated by dotted lines to clearly illustrate an internal configuration of the outdoor unit 1.

The outdoor unit 1 includes a casing 100. The casing 100 includes a bottom surface 10, a first side surface 11, a second side surface 12, a third side surface 13, and a fourth side surface 14. The bottom surface 10 has a rectangular shape. The first side surface 11, the second side surface 12, the third side surface 13, and the fourth side surface 14 are each provided at a side portion of the bottom surface 10 in a manner extending upward. The first side surface 11 is a front surface of the outdoor unit 1. The first side surface 11 and the third side surface 13 face each other, and extend in parallel to each other in a vertical direction. The second side surface 12 and the fourth side surface 14 face each other, and extend in parallel to each other in the vertical direction. The first side surface 11 is connected to the second side surface 12. The third side surface 13 is connected to the second side surface 12. The fourth side surface 14 is connected to the first side surface 11 and the third side surface 13.

The outdoor unit 1 includes a fan section 20, a heat exchange section 30, and a mechanical section 40. The fan section 20 is disposed on a top surface 15 of the casing 100, and is disposed above the first side surface 11, the second side surface 12, the third side surface 13, and the fourth side surface 14. The heat exchange section 30 is disposed below the fan section 20, and is disposed at an upper side portion of a rectangular columnar portion formed by the first side surface 11, the second side surface 12, the third side surface 13, and the fourth side surface 14. The mechanical section 40 is formed below the heat exchange section 30, at a lowest part of the casing 100. That is, the mechanical section 40 is disposed at a lower side portion of the rectangular columnar portion formed by the first side surface 11, the second side surface 12, the third side surface 13, and the fourth side surface 14.

A fan 21 is provided in the fan section 20. The fan 21 is covered by a fan guard 22. Air inside the casing 100 is caused to flow upward by the fan 21, and air outside the casing 100 is thereby supplied into the casing 100 through a heat exchanger 131 and a heat exchanger 132.

The heat exchanger 131 and the heat exchanger 132 are provided in the heat exchange section 30. The heat exchanger 131 and the heat exchanger 132 each have an L-shaped cross section. The heat exchanger 131 is arranged with one of surfaces forming the L shape extending along the first side surface 11 of the casing 100, and the other of the surfaces forming the L shape extending along the second side surface 12 of the casing 100. The heat exchanger 132 is arranged with one of surfaces forming the L shape extending along the third side surface 13 of the casing 100, and the other of the surfaces forming the L shape extending along the fourth side surface 14 of the casing 100. That is, all of the four surfaces of the casing 100, namely, the first side surface 11, the second side surface 12, the third side surface 13, and the fourth side surface 14 are provided with the heat exchanger 131 or the heat exchanger 132. In other words, side surfaces of the heat exchange section 30 are provided with the heat exchanger 131 or the heat exchanger 132, along an entire circumference.

An electrical component box 50, a compressor 60, and an accumulator 70 are provided in the mechanical section 40. The electrical component box 50, the compressor 60, and the accumulator 70 are disposed on the bottom surface 10. Accordingly, water or snow is highly likely to enter the electrical component box 50 from a lower part of the casing 100. In Embodiment 1, to prevent water and snow from entering the electrical component box 50, an opening is not formed in the bottom surface 10 of the casing 100 of the outdoor unit 1. Furthermore, no openings are formed between the bottom surface 10, and the first side surface 11, the second side surface 12, the third side surface 13, and the fourth side surface 14.

Figure 4:
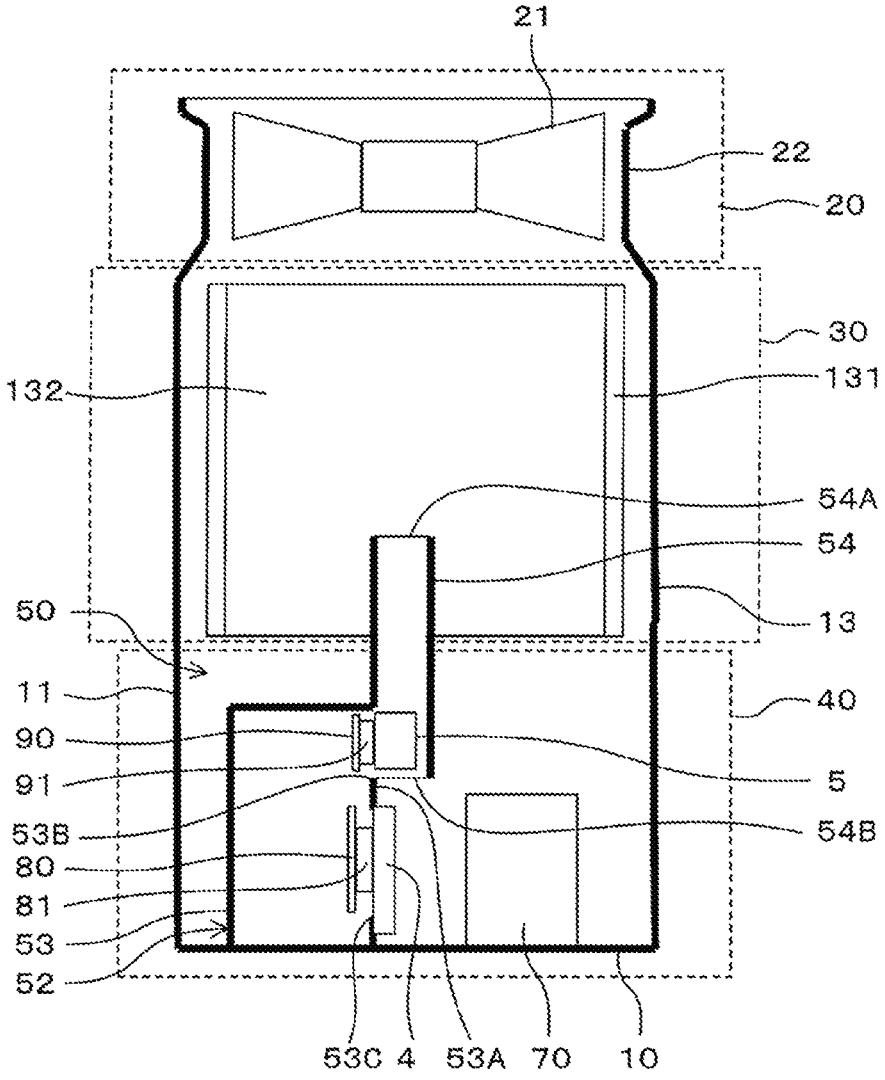
FIG. 4 is a diagram schematically illustrating an internal configuration of the heat exchanger unit from a side.
Figure 5:
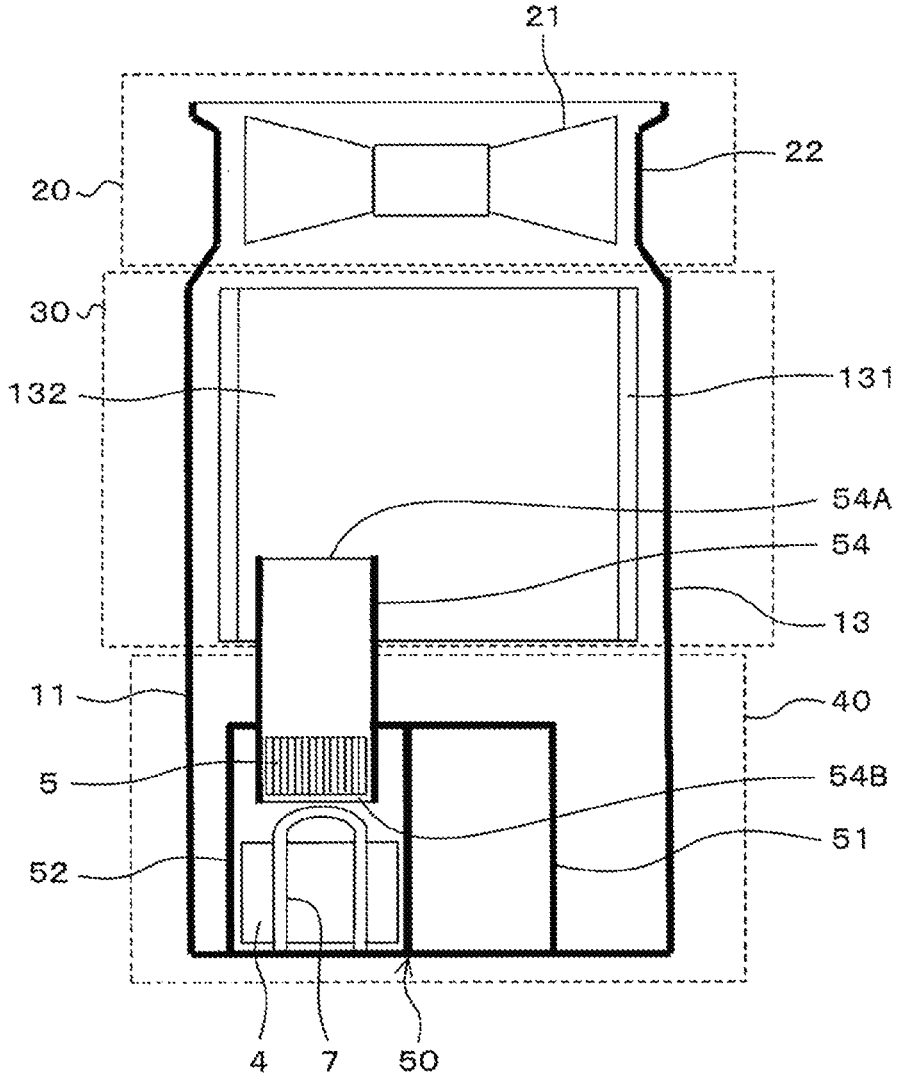
FIG. 5 is a diagram schematically illustrating the internal configuration of the heat exchanger unit from the side.

FIGS. 4 and 5 are diagrams schematically illustrating an internal configuration of the outdoor unit from a side. In FIG. 4, the outdoor unit 1 is cut at a position of a line A-A in FIG. 2, and is shown in a direction of arrows. In FIG. 5, the outdoor unit 1 is cut at a center, along a plane parallel to the first side surface 11 and the third side surface 13, and is shown from a side of the third side surface 13. The internal configuration of the outdoor unit 1 will be described with reference to FIGS. 3 to 5.

The electrical component box 50 is disposed on the bottom surface 10, along the first side surface 11 of the casing 100. In Embodiment 1, the electrical component box 50 includes a main box 51 and an inverter box 52. An electronic component that generates an extremely small amount of heat and that does not require cooling is mounted in the main box 51. An electronic component that generates a large amount of heat and that requires cooling is mounted in the inverter box 52. Details of the electronic component mounted in the inverter box 52 will be given later. The compressor 60 is disposed facing a side surface, of the main box 51, that is on an opposite side of a side surface facing an inner surface of the first side surface 11 of the casing 100 and that faces inside the casing 100. In other words, the compressor 60 is disposed behind the main box 51, namely, on the side of the third side surface 13. The accumulator 70 is disposed facing a side surface, of the inverter box 52, that is on an opposite side of a side surface facing the inner surface of the first side surface 11 of the casing 100 and that faces inside the casing 100. In other words, the accumulator 70 is disposed behind the inverter box 52, namely, on the side of the third side surface 13. The inverter box 52 is fixed on the bottom surface 10 of the casing 100. To shorten a wire from a power supply, a power supply terminal block not illustrated and an inverter to be described later are housed inside the inverter box 52. The main box 51 is movable, and is detachably attached to the bottom surface 10 such that the main box 51 can be removed to outside the casing 100. A wire connecting the main box 51 and the inverter box 52 is long enough to allow the main box 51 to be removed from the bottom surface 10 and to be pulled outside the casing 100. The main box 51 is a first box of the present invention, and the inverter box 52 is a second box of the present invention.

According to Embodiment 1, at the time of replacement and maintenance of the compressor 60, tasks may be performed simply by pulling the main box 51 to the front of the casing 100, and a task efficiency and ease of maintenance are increased. Furthermore, compared to a case of performing such tasks by moving the inverter box 52 to which a power supply wire is connected, a merit is also achieved with respect to safety, because tasks such as removing the power supply wire can be omitted.

The inverter box 52 includes a main body 53 and a duct 54. The main body 53 is a part having a box shape as a whole, and an opening 53B and an opening 53C are formed in a side surface 53A. The opening 53B and the opening 53C are arranged in the vertical direction, and on the side surface 53A, the opening 53B is positioned on an upper side, and the opening 53C is positioned on a lower side. The duct 54 is a cylindrical part, and has a rectangular columnar outer shape. The duct 54 is formed, while being integrated with the main body 53, at an upper edge portion of the side surface 53A of the main body 53 in a manner extending linearly in a direction perpendicular to the bottom surface 10 of the casing 100, or in other words, in a vertical direction of the casing 100. The main body 53 and the duct 54 communicate with each other through the opening 53B of the main body 53. An opening 54A is formed at an upper end of the duct 54, and an opening 54B is formed at a lower end. The upper end of the duct 54 protrudes above a lower end of the heat exchange section 30. That is, the opening 54A at the upper end of the duct 54 is positioned at a height that reaches the heat exchange section 30 even at a lowest part.

By linearly forming the duct 54 in the manner described above, airflow resistance of air flowing inside the duct 54 may be reduced, and a pressure loss may be reduced.

The inverter box 52 is disposed on the bottom surface 10 of the casing 100, with the side surface 53A of the main body 53 facing the third side surface 13 of the casing 100. That is, the side surface 53A of the main body 53 of the inverter box 52 faces inside the casing 100. Furthermore, the duct 54 extends to the heat exchange section 30 of the outdoor unit 1, and the upper end of the duct 54 protrudes above the lower end of the heat exchange section 30. That is, the upper end is surrounded by the heat exchanger 131 and the heat exchanger 132.

As illustrated in FIG. 4, a first control board 80 for driving a compressor and a second control board 90 for driving a fan are mounted inside the main body 53 of the inverter box 52. The first control board 80 is disposed overlapping the opening 53C of the side surface 53A of the main body 53. The second control board 90 is disposed overlapping the opening 53B of the side surface 53A of the main body 53. That is, on a back surface of the electrical component box 50, the first control board 80 is disposed below the second control board 90. A first power module 81 for driving a compressor is mounted on the first control board 80. The first power module 81 is fixed to the first control board 80 by soldering. A second power module 91 for driving a fan is mounted on the second control board 90. The second power module 91 is fixed to the second control board 90 by soldering. When a current necessary to drive the compressor 60 is supplied to a circuit forming the first power module 81, the first power module 81 generates heat and thus becomes a heat source. Furthermore, when a current necessary to drive the fan 21 is supplied to a circuit forming the second power module 91, the second power module 91 generates heat and thus becomes a heat source. Generally, a larger current has to be supplied to drive the compressor 60, than to drive the fan 21. Accordingly, compared with the second power module 91, the first power module 81 generates a larger amount of heat. That is, the first power module 81 corresponds to the heat source 31 illustrated in FIG. 1, and the second power module 91 corresponds to the heat source 32 illustrated in FIG. 1.

The heat radiating part 5 and the cooling part 4 are attached to the inverter box 52, on the side surface 53A that is a back surface opposite a front surface facing the first side surface 11 of the casing 100. The heat radiating part 5 is provided while being in contact with the second power module 91 for driving a fan. The heat radiating part 5 is in contact with the second power module 91 through the opening 53B of the side surface 53A of the main body 53. The cooling part 4 is provided while being in contact with the first power module 81 for driving a compressor. The cooling part 4 is in contact with the first power module 81 through the opening 53C of the side surface 53A of the main body 53. Configurations and functions of the heat radiating part 5 and the cooling part 4 are as described above with reference to FIG. 1.

The heat radiating part 5 attached to the side surface 53A of the electrical component box 50 is housed inside the duct 54. In other words, inside the casing 100, the duct 54 houses at least a part of the heat radiating part 5.

When the fan 21 mounted in the fan section 20 rotates, air in the heat exchange section 30 is guided upward inside the casing 100. A flow of air flowing upward is thereby generated around the opening 54A at the upper end of the duct 54. Air around the opening 54A at the upper end of the duct 54 is drawn upward by such flow of air, and thus, air inside the duct 54 is also drawn upward. A flow of air flowing from the opening 54B at the lower end of the duct 54 toward the opening 54A at the upper end is thus formed.

As illustrated in FIG. 1, in the present embodiment, the refrigerant pipe 7 connected to the cooling part 4 is connected from below the plate 6. When the copper refrigerant pipe 7 is at a top and the aluminum plate 6 is on a bottom with respect to a vertical relationship between the refrigerant pipe 7 and the plate 6, water containing copper ions possibly flows to the aluminum plate 6 due to gravity. This may result in electrolytic corrosion. Such electrolytic corrosion may be prevented by connecting the refrigerant pipe 7 from below the plate 6 as in the present embodiment.

In the present embodiment, the first control board 80 for driving a compressor is disposed on a back surface of the electrical component box 50, below the second control board 90 for driving a fan. If the second control board 90 is to be disposed below the first control board 80, the duct 54 has to be structured to extend upward from the lower part of the casing 100 toward the heat exchange section 30 while circumventing the first control board 80, the first power module 81, and the cooling part 4. This results in a pressure loss inside the duct 54. In contrast, by disposing the second control board 90 on an upper side as in the present embodiment, the duct 54 may be allowed to linearly extend in the vertical direction, and a pressure loss inside the duct 54 may be suppressed.

Furthermore, since a drive current of the compressor 60 is large, a thick wire is used as a wire connected to the compressor 60 from the first control board 80 for driving a compressor. By disposing the first control board 80 below the second control board 90 for driving a fan as in the present embodiment, a wire length of the wire connected to the compressor 60 from the first control board 80 may be reduced. Accordingly, even when a thick wire is used as the wire connected to the compressor 60, tension applied to a terminal connecting the wire and the first control board 80 may be reduced. Reducing the wire length may also suppress generation of noise.

The electrical component box 50 of Embodiment 1 uses air-cooling and refrigerant-cooling as a combination of cooling schemes, but such a combination is not restrictive.

Next, advantageous effects of Embodiment 1 will be described. As described above, in the electrical component box 50 of the outdoor unit 1, the first power module 81 for driving a compressor is the heat source 31 in FIG. 1 that generates a large amount of heat, and the second power module 91 for driving a fan is the heat source 32 in FIG. 1 that generates a small amount of heat. With the outdoor unit 1 according to Embodiment 1, the first power module 81 that is the heat source 31 that generates a large amount of heat is cooled by the cooling part 4 through heat absorption by refrigerant. Refrigerant-cooling by the cooling part 4 is applied only to the first power module 81. Accordingly, a temperature of the first power module 81 may be suppressed to an appropriate temperature by monitoring the temperature of the first power module 81 and controlling a flow rate of refrigerant inside the refrigerant pipe 7 of the cooling part 4. According to such refrigerant-cooling, the first power module 81 may be cooled without being affected by an installation environment of the electrical component box 50.

On the other hand, the heat radiating part 5 that promotes heat radiation of the second power module 91 that is the heat source 32 that generates a small amount of heat is cooled by air flowing through the duct 54. As illustrated in FIG. 2, even in a case where electrical component box 50 is installed on the bottom surface 10 of the casing 100, the upper end of the duct 54 protrudes above the lower end of the heat exchange section 30. That is, the upper end of the duct 54 is closer to the fan 21 than the lower end of the heat exchange section 30. Accordingly, a velocity of air flowing upward around the upper end of the duct 54 may be increased by the fan 21. Furthermore, air inside the duct 54 is drawn upward by the flow of air at the upper end of the duct 54, and thus, a velocity of air inside the duct 54 may be increased. Accordingly, compared to a case where the duct 54 is not provided, a velocity of air hitting the heat radiating part 5 is increased, and the second power module 91 may be sufficiently cooled.

As described above, the electrical component box 50 of Embodiment 1 adopts different cooling schemes for power modules with different amounts of heat generation. Therefore, a temperature that is suitable for properties of each power module may be maintained for each power module, without being affected by the amount of heat generation of another power module. Accordingly, occurrence of dew condensation around a power module with a small amount of heat generation that is caused by cooling of a plurality of power modules with different amounts of heat generation by same refrigerant and by the cooling part 4 may be prevented. Furthermore, by preventing dew condensation, corrosion that is possibly caused by dew condensation, of an electrode of a power module and of a wiring portion and the like of a control board where the power module is attached may be prevented, and also, insulation properties of the power module itself may be prevented from being reduced. As a result, reliability of an air-conditioning apparatus itself may be increased.

The second power module 91 for driving a fan generates a larger amount of heat, the greater a rotation speed of the fan 21. The amount of air that is suctioned by the fan 21 from outside the casing 100 to the inside is increased, the greater the rotation speed of the fan 21. Accordingly, the amount of heat generation of the second power module 91 is proportional to the amount of air that is suctioned by the fan 21 from outside the casing 100 to the inside. When the fan 21 is rotating at a high speed, the amount of heat generation is large, but since the amount of air is also increased, the second power module 91 may be sufficiently cooled. When the fan 21 is rotating at a low speed, the amount of air is small, but the amount of heat generation is also small, and thus, cooling does not become insufficient. Since the amount of heat generation of the second power module 91 is proportional to the amount of air that is suctioned by the fan 21 from outside the casing 100 to the inside, air-cooling is appropriate as the cooling scheme for the second power module 91 for driving a fan.

The first power module 81 for driving a compressor generates a larger amount of heat, the greater a rotation speed of the compressor 60. The amount of heat generation of the first power module 81 is not dependent on the amount of air that is suctioned by the fan 21 from outside the casing 100 to the inside. Accordingly, air-cooling is not necessarily appropriate as the cooling scheme for the first power module 81. That is, by adopting refrigerant-cooling as the cooling scheme for the first power module 81 for driving a compressor, an advantageous effect that most suitable cooling may be performed regardless of the installation environment of the electrical component box 50 may be achieved as described above.

Moreover, by adopting a different cooling scheme for each power module, synchronization of a timing of driving a compressor and a timing of driving a fan becomes unnecessary. With a configuration of cooling the first power module 81 for driving a compressor and the second power module 91 for driving a fan by same refrigerant and by the cooling part 4, the compressor 60 has to be driven to cool the second power module 91. However, control by the outdoor unit 1 does not have to be coordinated between driving of a fan and driving of a compressor, and control by the outdoor unit 1 is generally performed such that each component may be independently driven. To cool the second power module 91 for driving a fan, the electrical component box 50 of Embodiment 1 uses flow of air that is generated by driving of the fan 21, without applying refrigerant-cooling by the cooling part 4. Accordingly, even when the compressor 60 is not being driven, the second power module 91 may be cooled while the fan 21 is being driven.

Moreover, it is also conceivable to cool the first power module 81 for driving a compressor by a same configuration as that for cooling the second power module 91 for driving a fan of Embodiment 1, instead of by refrigerant-cooling by the cooling part 4. That is, the first power module 81 may be cooled by the heat radiating part 5 instead of by the cooling part 4, and the heat radiating part 5 may be covered by the duct 54. However, in the case where the mechanical section 40 is positioned below the heat exchange section 30 as illustrated in FIG. 2, since no openings are formed at the lower part of the casing 100 to prevent entering of water and snow into the electrical component box 50, as described above, air is not likely to flow at a high velocity. Accordingly, cooling both the second power module 91 and the first power module 81 is difficult even when the duct 54 is used, unless a size of the heat radiating part 5 is increased. In contrast, with the electrical component box 50 of Embodiment 1, the second power module 91, for driving a fan, with a small amount of heat generation is the only power module to which air-cooling is applied, and the heat radiating part 5 may thus be made small.

Moreover, as illustrated in FIGS. 2 to 4, in Embodiment 1, the heat exchange section 30 is disposed at an upper part of the casing 100, and the mechanical section 40 is disposed at a lower part of the casing 100, and the heat exchange section 30 and the mechanical section 40 are separated from each other. According to such a configuration, cooling can be performed regardless of installation conditions of the electrical component box 50, by using, in combination, air-cooling through the duct and refrigerant-cooling. That is, since the heat exchange section 30 and the mechanical section 40 are vertically arranged, the configuration of Embodiment 1 enables cooling to be performed with no problem even in an environment where cooling of the electrical component box 50 is difficult. Moreover, the heat exchanger 131 and the heat exchanger 132 may be disposed along all the side surfaces of the casing 100, namely, the first side surface 11, the second side surface 12, the third side surface 13, and the fourth side surface 14. With a general outdoor unit, the heat exchanger is not disposed on at least one side surface among side surfaces of the casing, and the electrical component box is often disposed on one such side surface. However, when the heat exchanger 131 and the heat exchanger 132 are disposed along all the side surfaces of the casing 100 as in Embodiment 1, areas where the heat exchanger 131 and the heat exchanger 132 contact air may be increased compared to that of a general outdoor unit. As a result, a heat exchange efficiency of the outdoor unit 1 may be increased.

Embodiment 2

Figure 6:
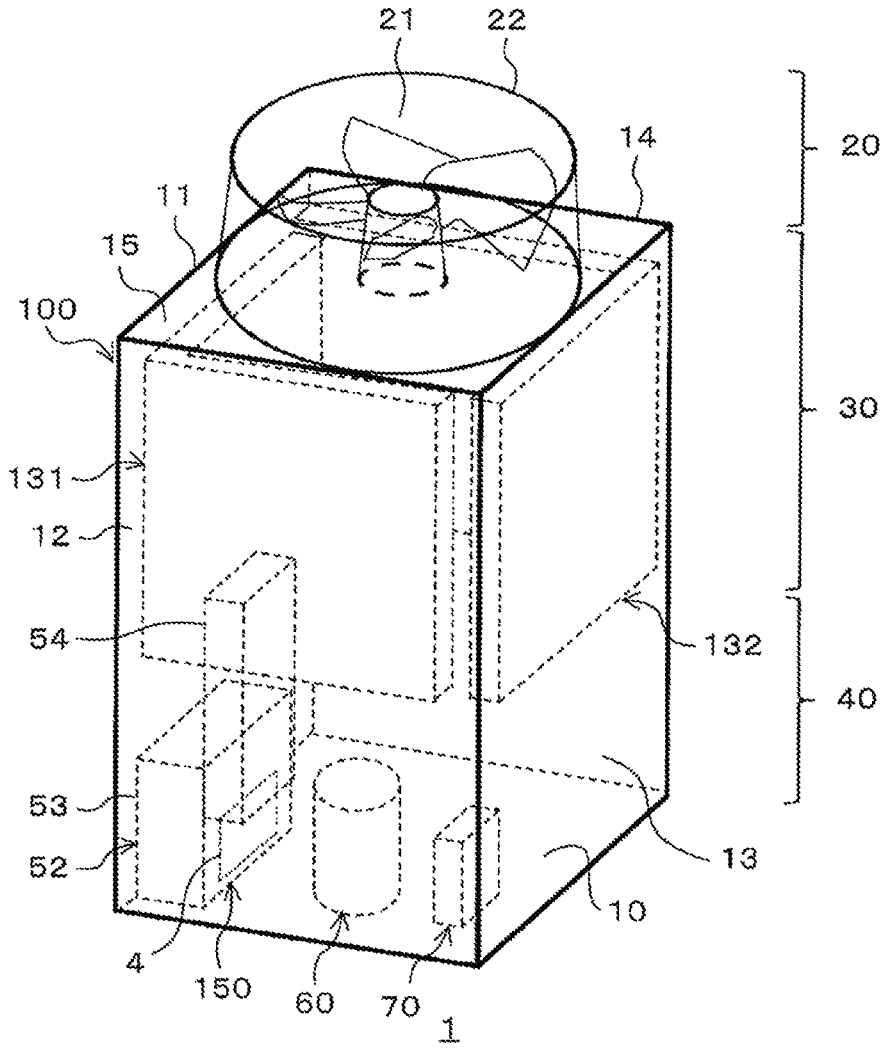
FIG. 6 is a perspective view schematically illustrating a heat exchanger unit according to Embodiment 2 of the present invention.

FIG. 6 is a perspective view schematically illustrating a heat exchanger unit according to Embodiment 2 of the present invention. In FIG. 6, components that are the same as those in Embodiment 1 are denoted by same reference signs. As in Embodiment 1, an electrical component box 150, the compressor 60, and the accumulator 70 of Embodiment 2 are disposed on the bottom surface 10. The compressor 60 is disposed on a side of a back surface of the electrical component box 150, and the accumulator 70 is disposed on a side of a back surface of the compressor 60. The first control board 80 for driving a compressor, the first power module 81, the second control board 90 for driving a fan, the second power module 91, the heat radiating part 5, and the cooling part 4 are mounted in the electrical component box 150. Furthermore, electronic components that are mounted in the main box 51 in Embodiment 1 are also mounted in the electrical component box 150. Additionally, in FIG. 6, these electronic components mounted in the electrical component box 150 are omitted to prevent the drawing from becoming complicated. The configuration is otherwise the same as that in Embodiment 1.

According to Embodiment 2, the electronic components mentioned above are housed in one electrical component box 150, and thus, an increase in the number of components may be prevented.

REFERENCE SIGNS LIST

1 outdoor unit 4 cooling part 5 heat radiating part 6 plate 7 refrigerant pipe 10 bottom surface 11 first side surface 12 second side surface 13 third side surface 14 fourth side surface 15 top surface 20 fan section 21 fan 22 fan guard 30 heat exchange section 31 heat source 32 heat source 40 mechanical section 50 electrical component box main box 52 inverter box 53 main body 53A side surface 53B opening 53C opening 54 duct 54A opening 54B opening 60 compressor 70 accumulator 80 first control board 81 first power module 90 second control board 91 second power module 100 casing 131 heat exchanger 132 heat exchanger 150 electrical component box

The invention claimed is:

1. A heat exchanger unit connected to a refrigerant pipe in which refrigerant is sealed, the heat exchanger unit comprising:

a plurality of heat sources, each of the heat sources having a different amount of heat generation; and a plurality of coolers each being configured to cool its associated one of the plurality of heat sources, wherein the heat exchanger unit is an outdoor unit including a compressor and a fan, the plurality of heat sources include a first power module configured to drive the compressor, and a second power module configured to drive the fan, the plurality of coolers include a first cooler configured to cool the first power module, and a second cooler configured to cool the second power module, the first cooler being configured to provide cooling to the first power module that is greater than cooling that the second cooler provides to the second power module, the outdoor unit including a fan section where the fan is disposed, a heat exchange section where a plurality of heat exchangers are disposed, a mechanical section where an electrical component box in which electronic components are mounted, and the compressor are disposed, wherein the heat exchange section is disposed below the fan section, and the mechanical section is disposed below the heat exchange section, and wherein the electrical component box includes a main body where the first power module, the second power module, the first cooler, and the second cooler are mounted, and a duct configured to guide air to which heat is radiated by the second power module to outside the main body, a first opening and a second opening are provided on a side surface of the main body of the electrical component box, the second opening being provided above the first opening, the main body and the duct communicate with each other through the second opening, the second cooler is in contact with the second power module through the second opening, the first cooler is in contact with the first power module through the first opening, and the duct extends above a lower end of the heat exchange section.

2. The heat exchanger unit of claim 1, wherein the first cooler is a cooling part configured to cool the first power module by refrigerant-cooling performed through heat exchange with the refrigerant in the refrigerant pipe connected to the compressor, and the second cooler is a heat radiating part configured to cool the second power module by air-cooling.

3. The heat exchanger unit of claim 2, wherein the first cooler includes a plate that is in contact with the first power module, and a part of the refrigerant pipe, and the part of the refrigerant pipe is connected from below the plate.

4. The heat exchanger unit of claim 1, wherein the second cooler is disposed above the first power module and the first cooler, and the duct extends linearly.

5. The heat exchanger unit of claim 1, wherein the plurality of heat exchangers are disposed on side surfaces of the heat exchange section, along an entire circumference.

6. The heat exchanger unit of claim 5, wherein the electrical component box includes a first box detachably attached to a casing of the outdoor unit, and a second box fixed to the casing of the outdoor unit, where the electronic components mounted in the second box includes the first power module, the second power module, the first cooler, and the second cooler.

7. The heat exchanger unit of claim 6, wherein the outdoor unit includes an accumulator, the compressor is disposed facing a side surface, of the first box, that is on an opposite side of a side surface facing an inner surface of the casing and that faces inside the casing, and the accumulator is disposed facing a side surface, of the second box, that is on an opposite side of a side surface facing the inner surface of the casing and that faces inside the casing.

8. An air-conditioning apparatus comprising the heat exchanger unit of claim 1.

* * * * *